United States Patent [19]

Carolus

[11] 4,198,638

[45] Apr. 15, 1980

[54] TELESCOPING ANTENNA MAST CONNECTOR

[75] Inventor: David T. Carolus, Dayton, Ohio

[73] Assignee: General Motors Corporation, Detroit, Mich.

[21] Appl. No.: 938,990

[22] Filed: Sep. 1, 1978

[51] Int. Cl.[2] ..... H01Q 1/32; H01Q 1/10

[52] U.S. Cl. ..... 343/715; 343/901

[58] Field of Search ..... 343/715, 901, 903; 174/153 A

[56] References Cited

U.S. PATENT DOCUMENTS

| | | | |
|---|---|---|---|
| 3,241,149 | 3/1966 | Berger | 174/153 A |
| 3,544,140 | 12/1970 | Langheck | 343/715 |
| 3,898,666 | 8/1975 | Massa | 343/702 |
| 4,136,986 | 1/1979 | Grashow et al. | 174/153 A |

FOREIGN PATENT DOCUMENTS

| | | | |
|---|---|---|---|
| 1141687 | 12/1962 | Fed. Rep. of Germany | 343/889 |

*Primary Examiner*—Eli Lieberman

*Attorney, Agent, or Firm*—Donald F. Scherer

[57] ABSTRACT

A telescoping vehicle radio antenna connector to permit the removal of the upper telescoping sections from the lower stationary section. A bearing member and stop ring are removably connected, by a retainer, to the stationary section at the upper end thereof to limit the upward movement of the lowermost telescoping section relative to the stationary section. The retainer has a resilient collar and depending arms having tabs formed thereon which tabs engage slots in the stationary section to maintain the telescoping and stationary sections of the antenna as a unit. The retainer can be rotated in one direction so that the tabs will be cammed out of the slots to permit removal of the telescoping section from the stationary section.

2 Claims, 5 Drawing Figures

TELESCOPING ANTENNA MAST CONNECTOR

This invention relates to telescoping antennas and more particularly to antennas having a removable connector to permit disassembly of the telescoping portion of the antenna from the stationary portion.

It is an object of this invention to provide an improved telescoping antenna and connector assembly.

It is another object of this invention to provide an improved telescoping antenna and connector assembly wherein the telescoping portion is removably connected to a stationary portion by a connector which provides a bearing surface and a linear stop surface for the telescoping portion and which connector may be disengaged from the stationary portion to permit removal of the telescoping portion.

These and other objects and advantages of the present invention will be more apparent from the following description and drawings in which.

Figure 1:
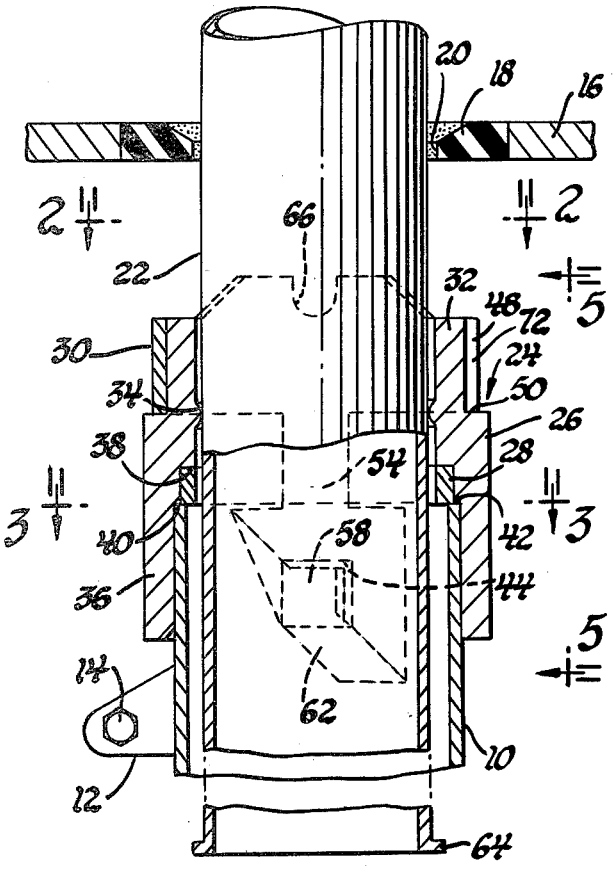
FIG. 1 is an elevational view partly in section of the connector and a portion of the antenna.

Referring to the drawings, wherein like characters represent the same or corresponding parts throughout the several views, there is seen a stationary antenna section or tube 10 which is adapted to be secured to a stationary vehicle body portion such as the inner fender wall, not shown, by a bracket 12 and a threaded fastener 14. The stationary section 10 is mounted below the upper surface of the fender shown at 16, which surface 16 has formed thereon a rubber seal member 18 having a circular opening 20 through which a telescoping antenna section or tube 22 may be extended and retracted.

Preferably, the telescoping portion 22 is extended and retracted by an electric motor and cable drive similar to that shown in U.S. Pat. No. 3,253,799 to Till, issued May 31, 1966.

The telescoping section 22 is prevented from being inadvertently disconnected from the stationary section 10 by a connector assembly, generally designated, 24. The connector 24 includes a bearing 26, a stop ring 28 and a retainer 30. The bearing 26 has an upper annular collar 32 in which is formed a semitoroidal bearing portion 34 and a lower annular segmented portion 36. The bearing portion 34 slidably supports the telescoping section 22 when it is being extended or retracted. The lower portion 36 has a first annular shoulder 38 formed thereon which positions the stop ring 28 and a second annular shoulder portion 40 which abuts the upper end 42 of the stationary section 10 to position the bearing 26. The stationary section 10 has formed therein a pair of essentially square openings or apertures 44 and 46 at a position slightly below the upper end 42.

The retainer 30 has a collar portion 48 which surrounds the upper annular collar portion 32 and abuts a shoulder portion 50 formed on the lower portion 36. A pair of retainer arms 52 and 54 depend downwardly and have formed thereon retainer tabs 56 and 58, respectively, which engage in the apertures 46 and 44, respectively. The retainer arms 52 and 54 also have formed thereon cam members 60 and 62, respectively.

The telescoping tube 22 has an annular flange 64 formed at the lower end thereof such that when the telescoping tube 22 is fully extended, the flange 64 will abut the stop ring 28 to prevent further linear extension of the telescoping tube 22. The stop ring 28 is maintained relative to the stationary tube 10 by the tabs 56 and 58 disposed in the apertures 46 and 44 such that the telescoping section 22 is maintained as an assembly with the stationary section 10.

It is possible for the upper telescoping sections of an antenna to become bent through attempted vandalism, or other misshapes, such that the telescoping antenna sections cannot be retracted. Prior art telescoping antennas require that the complete antenna assembly, that is, stationary tube, electric drive motor and telescoping tubes, must all be removed from the vehicle to permit replacement of the damaged sections. With the present invention, the connector 24 can be disengaged from the stationary tube 10 such that connector 24 and telescoping tube 22 can be removed upwardly through the fender 16 to permit replacement of the telescoping tube portions only. This, obviously, permits a timesaving and an economic saving in the replacement of telescoping power antennas.

Figure 5:
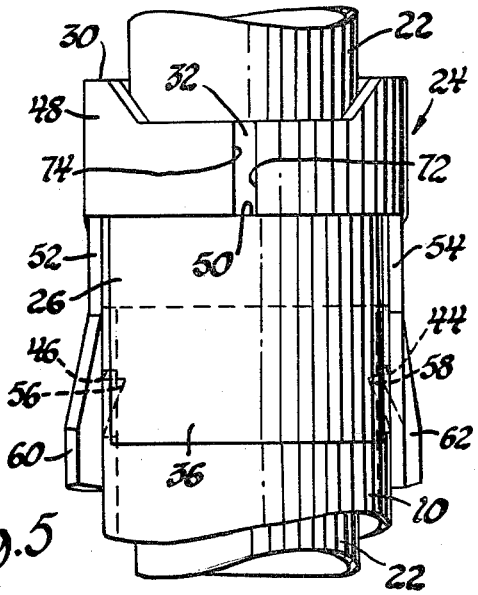
FIG. 5 is an elevational view viewed in the direction of line 5—5 of FIG. 1.

To accommodate the removal of the connector assembly 24, the retainer 30 has a pair of U-shaped drive slots such as 66 which can be engaged by a spanner wrench inserted through the opening in fender 16 to permit rotation of the retainer 30. When the retainer 30 is rotated in the counterclockwise direction, as viewed in FIG. 3, the cams 60 and 62 will engage flatted portions 68 and 70 formed on connector segments 36. The engagement of cams 60 and 62 and the rotation of retainer 30 will cause the depending arms 52 and 54 to be sprung outwardly thus removing the retainer tabs 56 and 58 from the apertures 46 and 44. The connector 24 and telescoping tube 22 can then be moved relative to the stationary tube 10. The collar 48 is not a complete annulus and the ends 72 and 74 are separated by a slight opening as seen in FIG. 5. As the retainer 30 is rotated, the annular collar 48 acts as a spring to permit the outward movement of the arms 52 and 54.

Figure 3:
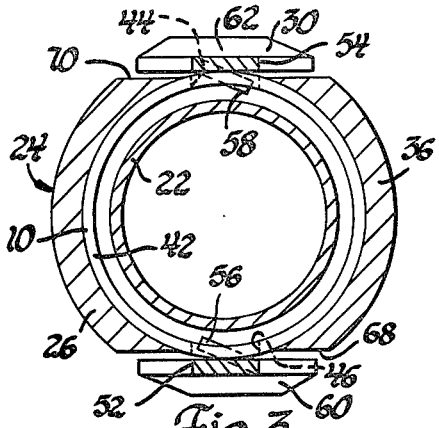
FIG. 3 is a sectional view taken along line 3—3 of FIG. 1.
Figure 4:
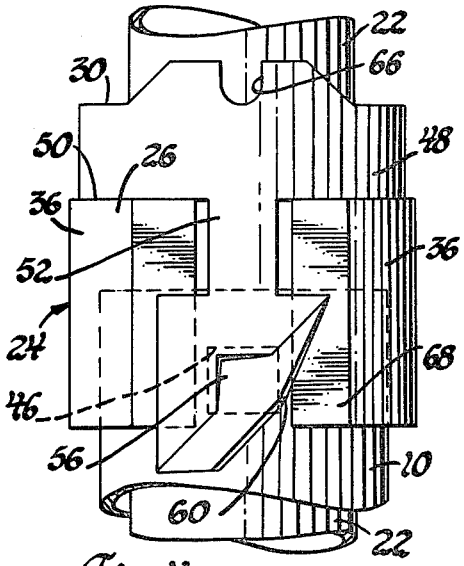
FIG. 4 is an elevational view viewed in the direction of line 4—4 of FIG. 2.
Figure 2:
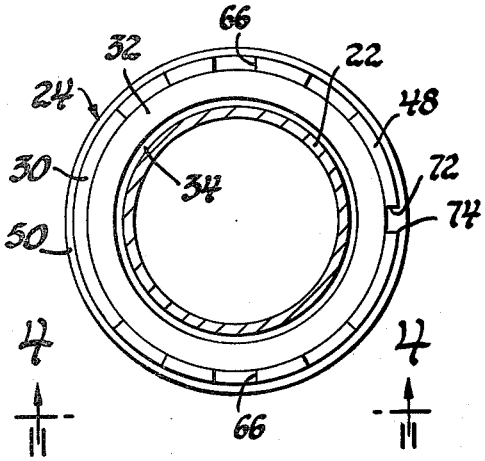
FIG. 2 is a sectional view taken along line 2—2 of FIG. 1.

A new telescoping section 22 and bearing assembly 24 can be secured to the stationary tube 10 by inserting the new assembly through the fender 16 onto the stationary tube 10 and rotating the connector assembly 24 in a clockwise direction, when viewed in FIG. 3, until the retainer tabs 56 and 58 engage the apertures 46 and 48, respectively. The telescoping section can, of course, have other tubular sections telescoped therein, as is well known. In a power antenna, the drive cable is connected to the uppermost telescoping member which has a threaded member thereon which can be removed to permit the remaining section to be removed from the cable. The replacement sections are reassembled on the cable by passing the uppermost section, with cable attached, longitudinally through the center of the other telescoping sections.

Obviously, the spring characteristics desired in the retainer 30 could be incorporated into the retainer arms 52 and 54, however, it is considered that the use of the split collar 48 to provide the spring characteristic reduces the possibility of the springs being overstressed during assembly. It should also be appreciated that the retainer tabs 56 and 58 can, if desired, provide the camming action necessary to permit their removal from the apertures 46 and 44. However, it is considered desirable to provide the larger camming surface available through the use of surfaces 60 and 62.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. In a motor vehicle wherein an antenna is extensible and retractable through an opening in a vehicle body member, a telescoping radio antenna and connector assembly, comprising; a stationary tubular member having retainer aperture means adjacent one end thereof and being secured to the vehicle body member below the opening therein; a movable tubular member telescopically disposed in said stationary tubular member; and connector means for limiting the linear movement of said movable tubular member in one direction, for guiding said movable tubular member and for permitting removal of said movable tubular member from said stationary tubular member comprising, an annular collar surrounding one end of said stationary tubular member, a stop ring means disposed in said annular collar for engaging a portion of said movable tubular member after a predetermined amount of linear movement thereof, a bearing surface formed on the inner surface of said annular collar contacting and guiding said movable tubular member during linear movement thereof, and a retainer having a spring collar engaging a portion of said annular collar and retainer tabs depending from said spring collar and engaging said retainer aperture means to secure said annular collar to said stationary tubular member, said spring collar and said retainer tabs preventing rotation of said spring collar in one direction and permitting rotation of the spring collar in the other direction whereby the spring collar can be selectively rotated to permit disengagement of said retainer tabs and disassembly of said movable tubular member from said stationary tubular member.

2. In a motor vehicle wherein an antenna is extensible and retractable through an opening in a vehicle body member, a telescoping radio antenna and connector assembly, comprising; a stationary tubular member having a pair of diametrically opposed retainer apertures adjacent one end thereof and being secured to the vehicle body member below the opening therein; a movable tubular member telescopically disposed in said stationary tubular member and having a stop surface adjacent one end thereof; and connector means for limiting the linear movement of said movable tubular member in one direction, for guiding said movable tubular member and for permitting removal of said movable tubular member from said stationary tubular member comprising, an annular collar surrounding one end of said stationary tubular member, a stop ring means disposed in said annular collar for engaging a portion of said movable tubular member after a predetermined amount of linear movement thereof, a semitoroidal bearing surface formed on the inner surface of said annular collar contacting and guiding said movable tubular member during linear movement thereof, retainer means having a split spring collar encircling a portion of said annular collar and a pair of diametrically opposed retainer tabs depending from said split spring collar substantially parallel with the outer surface of said stationary tubular member with each retainer tab engaging respectively said retainer apertures to secure said annular collar to said stationary tubular member, said spring collar and said retainer tabs preventing rotation of said split spring collar in one direction, and cam means on each of said retainer tabs for withdrawing said retainer tabs from said retainer apertures upon rotation of the split spring collar in the other direction whereby the spring collar can be selectively rotated to permit disengagement of said retainer tabs and disassembly of said movable tubular member from said stationary tubular member.

* * * * *